US005494471A

United States Patent [19]

Ryaa et al.

[11] Patent Number: 5,494,471

[45] Date of Patent: Feb. 27, 1996

[54] SADDLE FOR A TOY HORSE

[75] Inventors: Jan Ryaa; Dan V. Serber, both of Billund, Denmark

[73] Assignee: INTERLEGO AG, Baar, Switzerland

[21] Appl. No.: 307,905

[22] Filed: Sep. 16, 1994

[30] Foreign Application Priority Data

Sep. 22, 1993 [DK] Denmark ..... 1065/93

[51] Int. Cl.[6] ..... A63H 3/36

[52] U.S. Cl. ..... 446/268; 446/313

[58] Field of Search ..... 446/313, 98, 268; 54/44.1, 44.2, 37

[56] References Cited

U.S. PATENT DOCUMENTS 3,412,998 11/1968 Lott et al. ..... 446/268 X 4,519,787 5/1985 Williams ..... 446/313

4,718,877 1/1988 Girsch et al. ..... 446/313

FOREIGN PATENT DOCUMENTS 1112903 3/1956 France ..... 446/313

*Primary Examiner*—Mickey Yu

*Attorney, Agent, or Firm*—Kane, Dalsimer, Sullivan, Kurucz, Levy, Eisele and Richard

[57] ABSTRACT

On each of its sides the saddle (10) has a channel to receive part of the legs (21) of the toy figure (20) which are retained in the channel by a snap mechanism between its edges (12, 13). A child figure (30) may be retained in the saddle in that the foot (32) of the figure engages a downwardly directed face (16) of another laterally protruding part (15).

6 Claims, 1 Drawing Sheet

SADDLE FOR A TOY HORSE

BACKGROUND OF THE INVENTION

The invention concerns a saddle for a toy horse in which a toy figure may be placed in a riding position.

Toy horses having a saddle in which a toy figure may be placed in a riding position are known, but the saddle does not have means for retaining the toy figure. Therefore, the toy figure does not sit stably in such a saddle and therefore easily falls off the horse.

With the saddle of the invention it is possible to retain toy figures in a riding position in the saddle.

SUMMARY OF THE INVENTION

In a preferred embodiment the saddle of the invention has a channel on its sides to receive part of the legs of the toy figure. The channel has a width of opening which is smaller than the corresponding transverse dimension of the legs of the toy figure, and the channel may be expanded elastically so that the width of opening exceeds the transverse dimension of the leg, whereby the legs of the toy figure may be received in the channel and be retained in it. This channel for retaining the legs of the toy figure is preferably suitable for relatively large or "adult" toy figures.

Relatively small toy figures or "children" have thinner legs than the adult toy figures, and the legs of the child figures therefore cannot be retained in the same manner in the channel as the legs of the adults. Therefore, at the lowermost end of the channels the saddle has a laterally protruding part with a downwardly directed face which is adapted to engage the upper side of the feet of relatively small toy figures, such as children, which have shorter legs than the adult toy figures.

The saddle of the invention can thus retain both "adult" toy figures and "children" in a riding position in the saddle.

BRIEF DESCRIPTION OF THE DRAWINGS

The invention will be explained more fully below with reference to the drawing, in which FIG. 1 schematically shows an "adult" toy figure in a saddle according to the invention on a toy horse.

DETAILED DESCRIPTION OF THE PREFERRED EMBODIMENT

Figure 1:
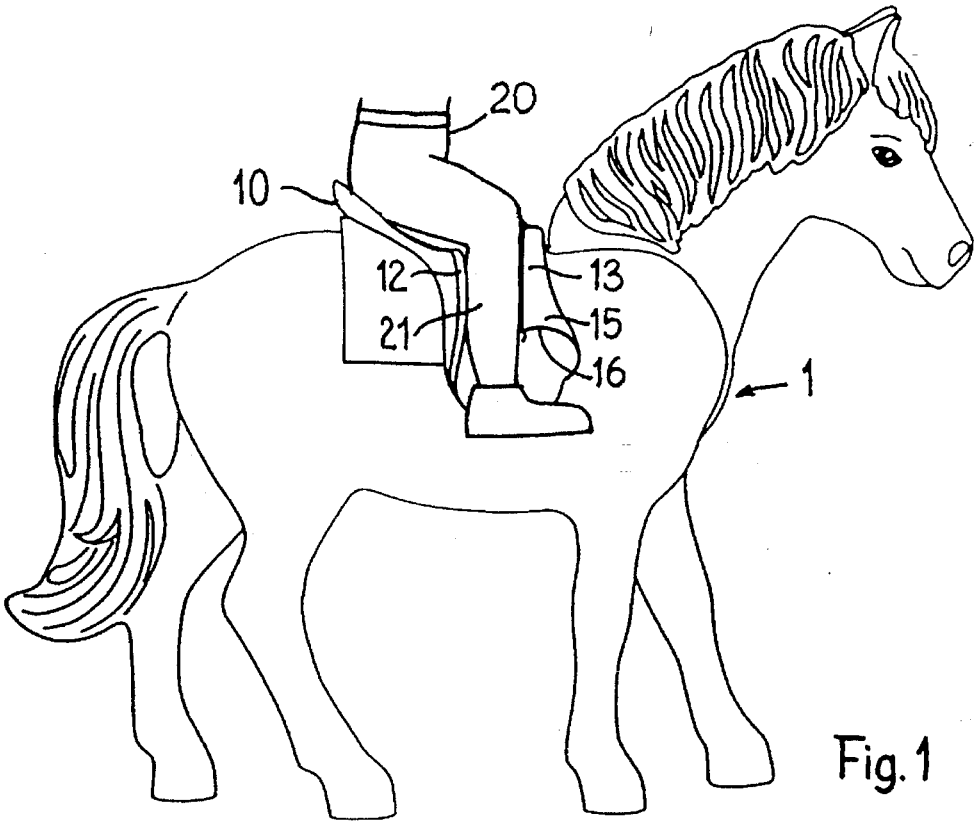

In FIG. 1 a horse 1 carries a saddle 10 on the back. An "adult" toy FIG. 20 sits in a riding position in the saddle 10, with the hip joints and knee joints of the figure being bent, and the figure has a leg 21 on each side of the saddle.

Figure 2:
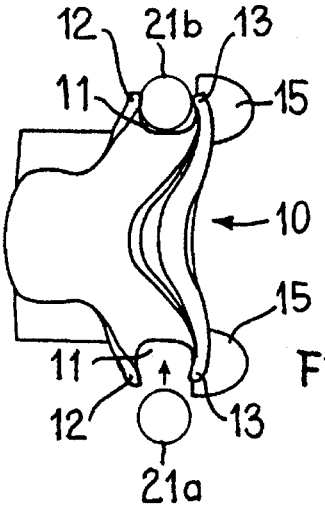
FIG. 2 shows the saddle of the invention from above and how the legs of the adult toy figure are placed and retained in the saddle, and FIG. 3 schematically shows a "child" toy figure in a riding position in the saddle of the invention.

FIG. 2 shows how the legs 21 of the figure are placed and retained in the saddle. At each side, the saddle has a pair of first lateral parts 12 and 13 which together define a channel

11, which extends substantially vertically and has a width of opening between the first lateral parts 12, 13 which is smaller than the corresponding transverse dimension of the part of the legs 21 of the figure which is to be received in the channel 11. The saddle is made of a plastics material permitting a certain elastic deformation, and one leg 21*a* of the figure may therefore be pressed into the channel 11 so that the leg 21*a* contacts the edges of the first lateral parts 12, 13 and forces these apart, so that the leg can get into and make contact with the bottom of the channel. The other leg 21*b* of the figure is shown in a position in which it engages the bottom of the channel 11 and is retained by the edges 12 and 13 of the channel. The adult toy FIG. 20 hereby sits firmly in the saddle.

Figure 3:
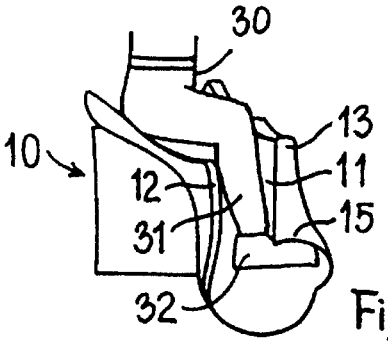

FIG. 3 shows a toy FIG. 30 sitting in the saddle 10. The toy FIG. 30 is smaller than the FIG. 20 and is called a child figure. The legs 31 of the child figure have a smaller diameter than the legs 21 of the adult figure, and the legs of the child figure cannot therefore be retained in the same manner in the channel 11. In FIG. 3 the foot 32 of the child figure is placed below another lateral part 15 on the saddle 10. The upper side of the foot 32 of the child figure engages a downwardly directed face 16 of the lateral part 15. The child figure is hereby retained in the saddle 10.

The lateral parts 13 and 15 are contiguous here and constitute a single laterally protruding part, which has faces adapted to engage the legs 21 of an adult figure and the foot 32 of a child figure, respectively, and the saddle can thus retain an adult figure as well as a child figure in a riding position in the saddle.

We claim:

1. A saddle (10) for a toy horse (1), in which a toy figure (20, 30) may be placed in a riding position wherein the saddle (10) has means (12, 3, 15) to releasably retain the toy figure (20, 30) in the riding position, said means including first lateral parts (12, 13) that define a channel (11) to receive and releasably secure a part of a leg (21) of the toy figure.

2. A saddle (10) according to claim 1, wherein the channel (11) has a width of opening which is smaller than the corresponding transverse dimension of the legs (21) of the toy figure, and that the channel (11) may be expanded elastically so that the width of opening exceeds the transverse dimension of the leg (21).

3. A saddle (10) according to claim 1, wherein the channel (11) defines a snap mechanism for the leg (21).

4. A saddle (10) according to claim 1 further comprising a second laterally protruding part (15) with a downwardly directed face (16) adapted to engage an upper side of one foot (32) of the toy figure.

5. A saddle according to claim 4, wherein the channel is defined between edges of the parts (12, 13) and further comprising a second laterally protruding part (15) provided at a lower end of the channel (11) and adjoining an edge of one of the parts (13) of the channel (11).

6. A saddle (10) according to claim 2, wherein the channel (11) defines a snap mechanism for the leg (21).

* * * * *